United States Patent [19]

Mucheyer et al.

[11] Patent Number: 4,510,847

[45] Date of Patent: Apr. 16, 1985

[54] APPARATUS FOR ADJUSTING THE POSITION OF AN ADJUSTABLE ELEMENT

[75] Inventors: Norbert Mucheyer, Rechtenbach; Wolfgang Kauss, Lohr-Wombach, both of Fed. Rep. of Germany

[73] Assignee: Mannesman Rexroth GmbH, Lohr, Fed. Rep. of Germany

[21] Appl. No.: 347,071

[22] Filed: Feb. 8, 1982

[30] Foreign Application Priority Data

Feb. 19, 1981 [DE] Fed. Rep. of Germany ..... 3106086

[51] Int. Cl.[3] ..... F15B 11/08

[52] U.S. Cl. ..... 91/461; 91/388; 91/403; 91/410

[58] Field of Search ..... 91/31, 461, 433, 388, 91/358 R, 410, 403

[56] References Cited

U.S. PATENT DOCUMENTS

| | | | |
|---|---|---|---|
| 3,213,886 | 10/1965 | Pearne | 91/461 |
| 3,583,422 | 6/1971 | Dach | 91/433 |
| 3,771,802 | 11/1973 | Hiramatu | 91/31 |
| 3,805,674 | 4/1974 | Sebesta | 91/461 |
| 3,872,773 | 3/1975 | Denker | 91/461 |
| 4,148,248 | 4/1979 | Risk | 91/461 |
| 4,350,209 | 9/1982 | O'Connor | 91/387 |
| 4,404,897 | 9/1983 | Leonard | 91/461 |
| 4,421,012 | 12/1983 | Mucheyer | 251/209 |

*Primary Examiner*—Abraham Hershkovitz

*Attorney, Agent, or Firm*—Walter C. Farley

[57] ABSTRACT

A device for the positioning of an adjustment element dependent upon a desired level and the actual level, particularly for the adjustment of a hoist gear train of a tractor, a combine or the like, has an operating circuit 10, which has a multi-way valve 3 pressure-operated in two directions, and a control circuit 29 for the operation of the multi-way valve, connected to a pressure source 19, which is connected to two control devices 11, 12 of the multi-way valve. Circuit 29 has two adjustable series-connected throttles 22, 24, connected to one of the two control devices. The first throttle 24 is also connected to a tank 7 and the second throttle 22 is also connected to pressure source 19. Both throttles have the same maximum flow-through cross section, and are adjustable in the same manner. Third and fourth throttles 27, 28 are provided, one being between the pressure source and control device 11, and the other between the control device and tank 7. The third and fourth throttles 27, 28 are each adjustable throttles, so that both control devices of the multi-way valve can be influenced as desired. The throttles are mounted in series and have the same flow-through cross section and are adjustable in the same manner. The maximum flow-through cross section of the third and fourth throttles is selected in the same manner as the flow-through cross section of the first and second throttles.

3 Claims, 5 Drawing Figures

FIG. 2
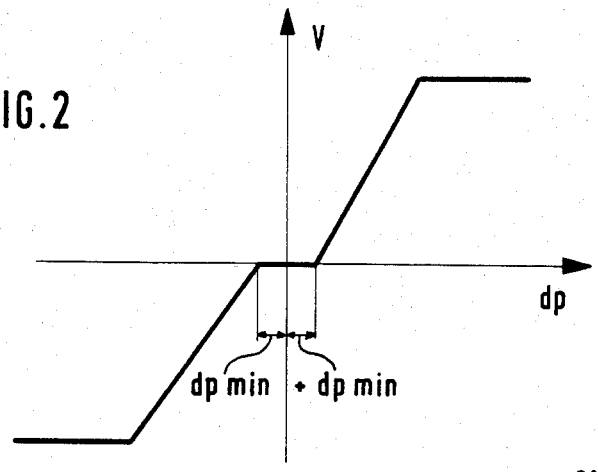
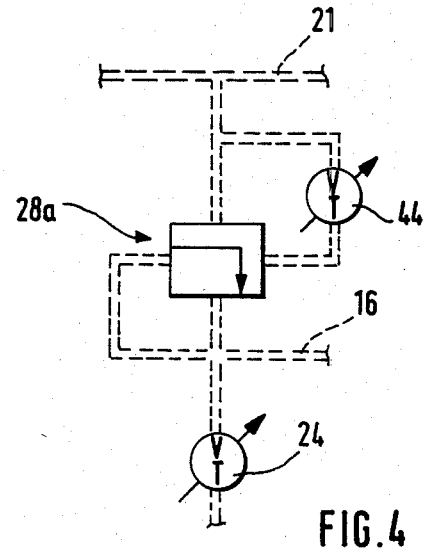
FIG. 4
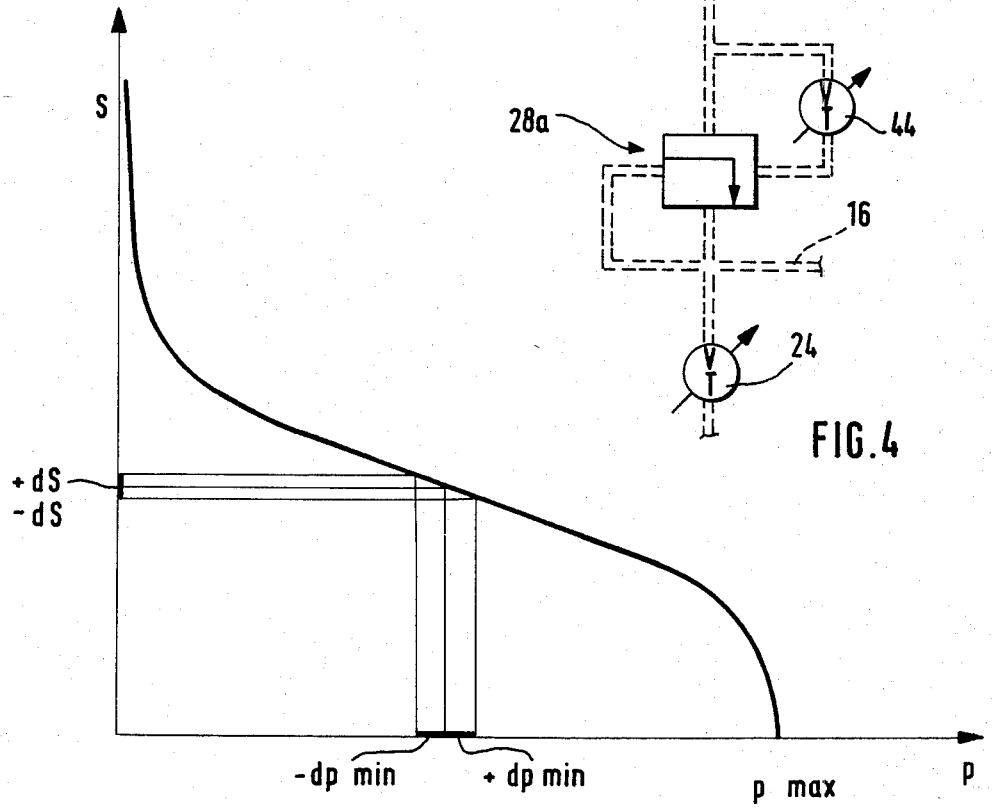
FIG. 3

APPARATUS FOR ADJUSTING THE POSITION OF AN ADJUSTABLE ELEMENT

This invention relates to an apparatus for controlling the position of a movable member and particularly for controlling a hoisting unit associated with a tractor, combine or the like. This invention is an improvement on the subject matter of U.S. patent application Ser. No. 188,453, filed Sept. 18, 1980, the content of which is hereby incorporated by reference.

The present invention relates to the apparatus as disclosed in application Ser. No. 188,453 wherein both control devices of a multi-way valve can be controlled as desired. Because the two control devices of the main multi-way valve can be acted upon as desired, it is possible to adjust one control device to correspond to the position of the element to be adjusted, and to adjust the other control device to correspond to the force being applied to the element to be adjusted.

Also in accordance with the invention, the responsiveness of a pressure ratio valve can be adjusted. When the responsiveness or sensitivity is high, the effect of one of the control parameters is eliminated. When there is strong damping or buffering of the pressure ratio valve, a change in the cross section of one of the throttles designed for the nominal pressure will be fully reflected back to the control circuit.

As will be seen, when the bypass throttles are opened, the damping of each control device is affected by the cross section of the corresponding bypass throttle. In fact, the damping can be so pronounced that the control device becomes practically ineffective. The bypass throttles are provided preferably where the exertion of predetermined force by the adjustment element effects the control device of the multi-way valve.

In accordance with other features, the apparatus can accomplish rapid operation of the adjustable element wherein the influx of the pressure agent from the pressure source connected with the control circuit can be switched off in order to minimize loss of power.

Briefly described, the invention includes an apparatus for the control of an adjustable member as a function of a command signal and an actual value, especially for positioning a hoisting means on a tractor or the like, the apparatus being of the type having a source of fluid under pressure, an operating circuit including a bidirectionally operable multi-way valve, first and second pressure responsive control devices for actuating the valve, a control fluid circuit connected to operate the control devices, the control circuit having two adjustable throttles having the same maximum flow-through cross sections and being adjustable in the same manner, the two throttles being connected in series so that one is connected between the fluid pressure source and the first control device and the other is between the first control device and a tank, the maximum flow-through cross section for the throttles being selected so that the minimum necessary change in cross section at a predetermined minimum pressure $d_{min}$ to which the movable portion of the multi-way valve first responds is in accordance with a substantially linear relationship and is multiplied by a predetermined precision factor F, wherein $F=100/G$ where G is a desired precision expressed in percent, to which is added the minimum necessary cross section for a throttle, and further comprising third and fourth adjustable throttles connected in series with each other, said third and fourth throttles having the same flow-through cross section and being adjustable in the same manner, the maximum flow-through cross section thereof being determined in the same manner as for said first and second throttles, and means for connecting said third and fourth throttles between said pressure source and said tank so that the junction therebetween is connected to said second control device.

In order that the manner in which the foregoing and other objects are attached in accordance with the invention can be understood in detail, particularly advantageous embodiments thereof will be described with reference to the accompanying drawings, which form a part of this specification, and wherein:

FIGS. 2 and 3 are volume-pressure and throttle surfaces-pressure diagrams illustrating operational aspects of the apparatus in accordance with the invention;

FIG. 4 illustrates a modification of the apparatus of FIG. 1; and

Figure 1:
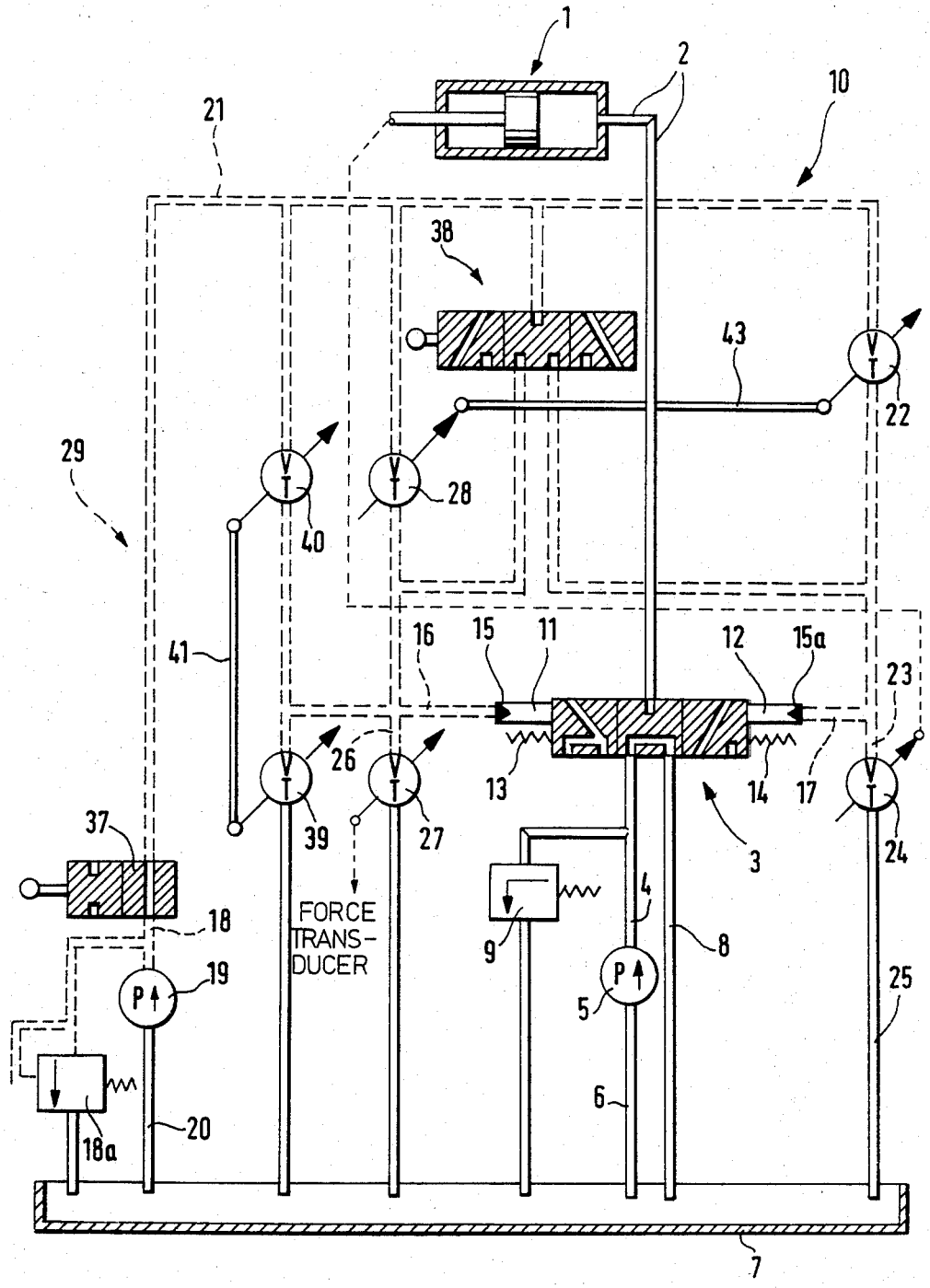
FIG. 1 is a schematic fluid and control circuit diagram of a first embodiment of an apparatus in accordance with the invention.

As seen in FIG. 1, an adjustable element 1 is illustrated in the form of a simply constructed piston and cylinder apparatus which is connected by a fluid line 2 with a multi-way valve 3 which can be reciprocatingly actuated by control pressure. The pressure side of a pump 5 is connected to valve 3 by a fluid line 4, the intake line 6 of pump 5 extending into a tank 7. Valve 3 is connected through a line 8 with tank 7. Line 4 is also connected to a pressure limiting or pressure relief valve 9 of which the discharge side is connected to tank 7. Components 1 through 9 form an operating loop which is generally indicated at 10.

Valve 3 is provided with control devices 11 and 12 at opposite ends thereof for operating its movable slide. These devices, under the influence of a pressure medium (liquid or gas) tend to move the slide in opposition to the effects of one of the control springs 13 or 14 in the direction of arrows 15, 15*a* which are shown in the control devices to which they relate. The two control springs 13, 14 tend to hold the slide in its middle position, as illustrated, when control devices 11, 12 are not actuated. A control line 16 is connected to control device 11 and a control line 17 is connected to control device 12. A control line 18 is connected to the pressure side of a control pump 19 of which the intake line 20 is connected with tank 7. A pressure limiting valve 18*a* is connected with control line 18. A control line 21 is connected to control line 18 through a two port, two position valve 37 which leads to an adjustment throttle 22. A control line 23 connects adjustment throttle 22 to an adjustment throttle 24 which is connected through a line 25 with tank 7. The control line 23 is connected to control line 17. Two adjustment throttles 27 and 28 are connected with control line 16 through control line 26 and the other side of adjustment throttle 27 is connected to tank 7. The other side of adjustment throttle 28 is connected to control line 21. The control elements thus described are identified as a control circuit indicated generally at 29.

Adjustment throttles 22 and 28 have mechanically movable adjustment elements which are connected with each other by a mechanical link 43 so as to be counter-rotating. These throttles are configured as a supplier of a reference setting, and adjustment throttles 24 and 27 are configured such that control parameters are applied to them, making them an actual value transmitter, connected with the movable part of adjustable element 1. In order to stabilize the control slide of valve 3 in its movement, control device 11 preferably has the same effective cross section as control device 12.

As shown in FIG. 2, the volume V propelled by pump 5 through multi-way valve 3 per unit time is a function of the differential pressure, indicated as dp, applied to and influencing control devices 11, 12. When the slide of valve 3 is in its middle position, there is a minimum effective differential pressure $dp_{min}$ which must be applied to cause the slide to leave its neutral position and to cause the pressure agent to immediately begin to flow through valve 3.

FIG. 3 shows the relationship between the cross sectional surface S of a throttle as a function of the pressure px prevailing at the input side (upstream) of the throttle under constant propulsion pressure $p_{max}$ produced by the control pump 19 and throttle mounted upstream of this throttle. The adjustable cross section of adjustment throttles 22 to 24 is selected as follows. The essentially linear portion in the middle of the curve illustrated in FIG. 3 shows how much the cross sectional surface dS of the throttle must be reduced in order to produce the pressure deviation $dp_{min}$ between control devices 11, 12 in a positive or negative sense.

The precision with which the slide of multi-way valve 3 must respond to a variation in the cross section of one or both of adjustment throttles 22, 24 depends upon a precision G expressed in percentage. The product of this and a precision factor F by which dS must be multiplied in order to attain the largest flow-through cross section of the valve necessary for control is 100. Thus, if the precision G is to be 2%, the precision factor F is equal to 50. The maximum adjustable cross sectional surface of throttle 22 is the sum of the largest flow-through cross section ($F \times dS$) necessary for the control and of the minimum flow-through cross section which is characteristic for each respective adjustment throttle.

By connection of the two adjustment throttles 22, 24 in series, the flow-through volume V is practically proportional to the level setting (for each adjusted state) wherein the same pressure is always set in line 23.

Bypass throttles 39 and 40 are connected in parallel with throttles 27 and 28, respectively. The movable adjustment elements for throttles 39 and 40 are connected to each other by a mechanical link 41 such that the two throttles 39, 40 can only be operated together and only in the same direction. The influence of throttles 27 and 28 becomes gradually smaller with progressive opening of throttles 39, 40.

The connection between control pump 19 and control circuit 29 can be switched on or off at will by means of the switch valve 37 which is mounted between control lines 18 and 21.

A second switch valve 38 has three port connections which are connected to the lines 16, 17 and 21, respectively. When the control element of switch valve 38 is in the position shown in the drawing, lines 16, 17 and 21 are disconnected from each other at the switch valve 38. In both of the other control positions of the control element of switch valve 38, line 21 is connected directly either with line 16 or with line 17.

The second switch valve 38 serves as a quick make or break switch for rapid operation of adjustment element 1. Thus, either one of the control devices 11, 12 can be switched to pressure control whereupon pressure is fed very rapidly to element 1 which is then operated very rapidly. The flow of pressure agent to control circuit 29 is cut off by closure of switch valve 37 when adjustment element 1 is sufficiently activated, i.e., when the piston within the cylinder that controls it is in its end position. When the control element of control valve 38 has returned to its position shown in the drawing, switch valve 37 can manually be returned to the position shown in the drawing.

Both bypass throttles 39, 40 can be entirely closed or can be opened together to a predetermined flow-through cross section. These throttles dampen the effect of control valves 27 and 28 acting on control device 11, and can completely eliminate that effect when they are totally opened. Other intermediate settings can also be attained by means of bypass valves 39, 40.

FIG. 4 shows an arrangement which is usable if there are no bypass throttles 39, 40 wherein throttle 28 can be configured as a pressure ratio valve 28*a* which holds the pressure in control device 11 at any given pressure, for example, one half of the control pressure, regardless of the size of the opening of throttle 27. The sensitivity of pressure ratio valve 28*a* can be made adjustable by inserting an adjustable throttle 44 in its control line. If the sensitivity is high, the effect of the actual level indicator on the control device is eliminated. If the sensitivity is low, a variation in the cross section of throttle 27 can exert its full effect on control circuit 29. The effectiveness of adjustment element 1 can be determined with modification of the sensitivity of pressure ratio valve 28*a*.

Figure 5:
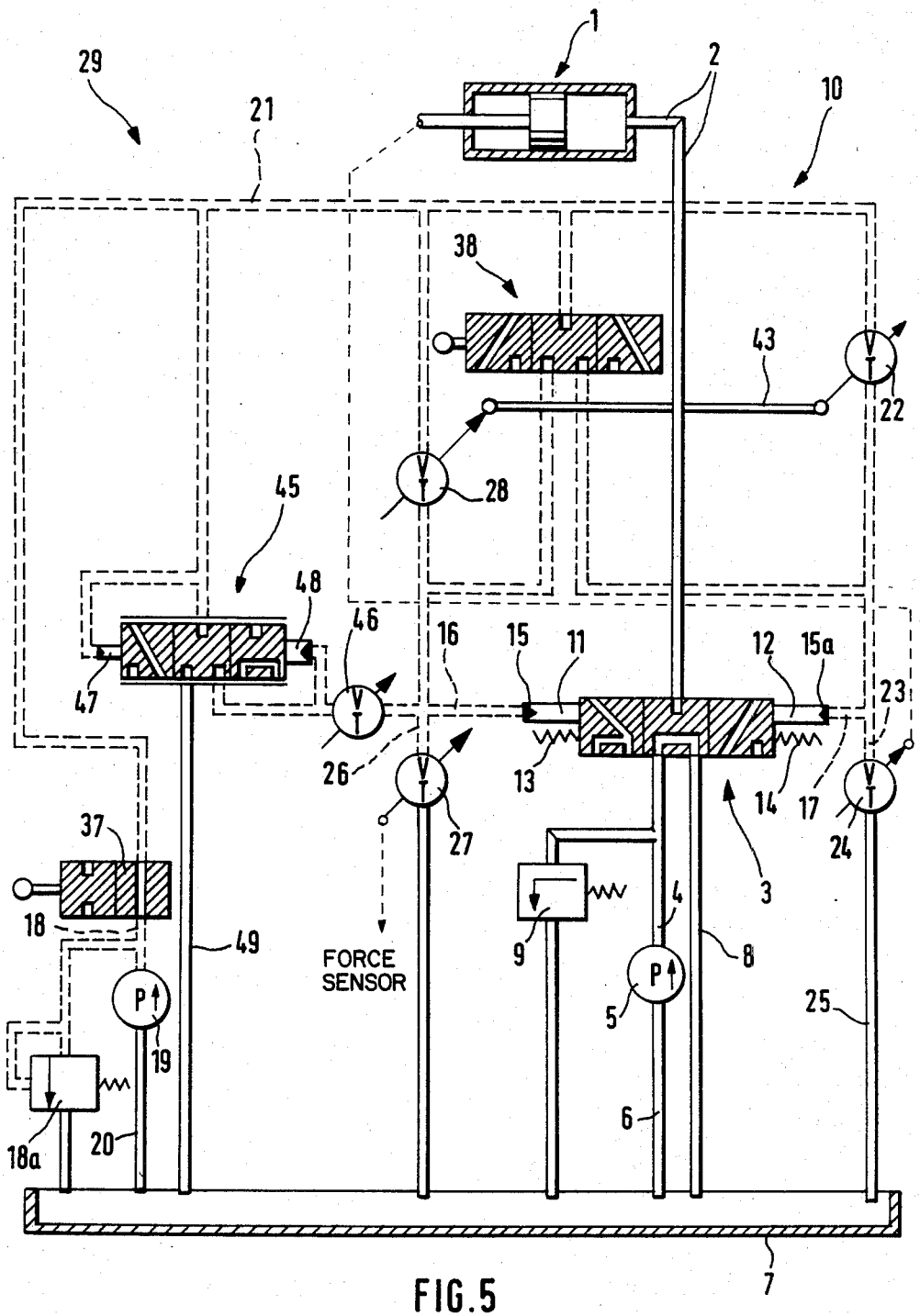
FIG. 5 is a circuit diagram of a further embodiment in accordance with the invention.

A further embodiment of an apparatus in accordance with the invention is illustrated in FIG. 5 wherein bypass throttles 39, 40 are replaced by a pressure ratio valve 45 which is in the configuration of a three-position, three-port, proportional valve with two control devices 47 and 48. Control device 47 has a smaller pressure surface than that of control device 48, and the pressure surface of control device 47 is preferably half as large as the pressure surface of control device 48. Control device 47 is connected to control line 21 which also leads to a connection point of pressure ratio valve 45. The second control device 48 is connected to a second connection point of pressure ratio valve 45 and also through an adjustable throttle point 46 to control line 16. A third connection point of the pressure ratio valve is connected through a line 49 to tank 7. When throttle 46 is open, pressure ratio valve 45 acts on control device 11 of multi-way valve 3 without activating throttles 27, 28. Any change in the adjustment of throttles 27 and 28 is compensated by pressure ratio valve 45. Th stronger the influence of the adjustable throttle setting 46, the lower the effect of pressure ratio valve 45 on control device 11.

The adjustment level can also be designated as the actual value and the reference level as the desired value. With a practical configuration of the exemplary embodiments of FIG. 1, adjustment throttles 22, 24 affect the position of the hoist gear train of a tractor, while adjustment throttles 27 and 28 affect its traction force.

While certain advantageous embodiments have been chosen to illustrate the invention it will be understood by those skilled in the art that various changes and modifications can be made therein without departing from the scope of the invention as defined in the appended claims.

What is claimed is:

1. An apparatus for controlling the position of an adjustable member in response to a command signal and an actual value signal comprising the combination of a source of fluid under pressure;

an operating circuit including a bidirectionally operable multi-way valve for controlling the flow of pressurized fluid to the adjustable member and first and second pressure responsive control devices for actuating said multi-way valve;

a control fluid circuit connected to operate said first and second control devices, said control circuit including first and second adjustable throttles having the same maximum flow-through cross-sections, being adjustable in the same manner and being connected in series with each other, means for connecting the series circuit including said first and second throttles between said pressure source and a tank with the junction therebetween connected to said first control device, third and fourth adjustable throttles connected in series with each other, having the same maximum flow-through cross sections and being adjustable in the same manner, means for connecting the series circuit including said third and fourth throttles between said pressure source and said tank with the junction between said throttles connected to said second control device;

a pressure ratio valve connected between said pressure source and said tank, said pressure ratio valve having third and fourth control devices having pressure responsive surfaces of different sizes;

means for connecting said third control device with the smaller surface to said pressure source;

a fifth adjustable throttle; and means for connecting said fourth control device with the larger surface through said fifth adjustable throttle to said first control device.

2. An apparatus according to claim 1, wherein the adjustment devices of said first and third throttles are connected mechanically with each other to operate in opposite directions.

3. An apparatus according to claim 1 or 3 and further comprising a first switch valve connected between said pressure source and said control circuit; and a second switch valve having a first port connected to said pressure source and second and third ports connected respectively to the connections between said first throttle to said first control device and said third throttle to said second control device such that either one of said first and third throttles can be bypassed by said second switch valve.

* * * * *